United States Patent [19]

Hofmeister et al.

[11] Patent Number: 4,715,925

[45] Date of Patent: Dec. 29, 1987

[54] APPARATUS FOR FORMING CONNECTION BRIDGES BETWEEN STACKS OF CORRUGATED CARDBOARD SHEETS IN A CORRUGATOR

[75] Inventors: Walter Hofmeister, Henstedt-Ulzburg; Günter Demmin, Hamburg, both of Fed. Rep. of Germany

[73] Assignee: Peters Maschinenfabrik GmbH, Fed. Rep. of Germany

[21] Appl. No.: 14,349

[22] Filed: Feb. 13, 1987

[30] Foreign Application Priority Data

Feb. 15, 1986 [DE] Fed. Rep. of Germany ..... 3604870

[51] Int. Cl.[4] ..... B31F 1/00

[52] U.S. Cl. ..... 156/470; 53/447; 53/540; 156/546; 156/558; 156/559; 156/563; 206/451; 414/904

[58] Field of Search ..... 156/544, 546, 563, 558, 156/559, 269, 353, 470, 554, 552, 545; 53/447, 157, 531, 540; 206/451, 454, 460; 414/904, 28; 493/204

[56] References Cited

U.S. PATENT DOCUMENTS 3,550,493 12/1970 Benbenek .
3,981,758 9/1976 Thayer et al. ..... 156/470

FOREIGN PATENT DOCUMENTS 3213895 10/1983 Fed. Rep. of Germany .
439391 12/1935 United Kingdom .

*Primary Examiner*—Jerome Massie
*Assistant Examiner*—David Herb
*Attorney, Agent, or Firm*—Harness, Dickey & Pierce

[57] ABSTRACT

Apparatus for stacking of corrugated cardboard sheets on at least two stacks disposed adjacent each other in a stacker included in a corrugator, wherein a slitter scorer, first conveying means, cut-off means, second conveying means and a stacker are located each behind the other in conveying direction, characterized in that at least one applying means is located above the first conveying means, said applying means being supported for movement transverse to the conveying direction and said applying means being adapted to apply adhesive strips, self-adhering paper strips or the like to adjacent webs.

3 Claims, 3 Drawing Figures

APPARATUS FOR FORMING CONNECTION BRIDGES BETWEEN STACKS OF CORRUGATED CARDBOARD SHEETS IN A CORRUGATOR

The invention relates to an apparatus for stacking of corrugated cardboard sheets on at least two stacks located adjacent each other in a stacker of a corrugator.

It is known from the U.S. Pat No. 3,550,493 to divide a corrugated cardboard web into individual smaller webs by a slitter scorer. Such individual webs usually are deflected groupwisely in conveying means in front of the cut-off means. A group of webs are fed to lower cut-off tools and another group is fed to upper cut-off tools. Further conveying means are arranged behind the cut-off means, the conveying means receive the cardboard sheets from the cut-off means in squamous or overlapping form. The conveying means convey the sheets to the stacker. The number of webs corresponds to the number of squamous sheet flows on the second conveying means to the stacker. The stacker forms individual adjacent stacks corresponding to the number of webs. If for instance three squamous sheet flows are conveyed to a first stacking platform three adjacent stacks are built up.

The stacks in the stacker reach a considerable height. Above all in case of narrow formates it could occur that the stacks will become disarranged or lose their balance.

The object of the invention is to provide an apparatus for stacking of corrugated cardboard sheets on at least two adjacently arranged stacks in a corrugator which effects a stabilization of adjacent stacks independent from the kind and the structure of the slitter scorer. The apparatus should be adapted to be mounted in existing corrugators. This problem is solved by the features of claim 1.

In the apparatus according to the invention at least one applying means is arranged above the first conveying means between the slitter scorer and the cut-off means, the applying means being supported for movement transverse to the longitudinal extension of the webs. By means of the applying means adhesive strips, self-adhering paper strips or the like can be applied to adjacent webs. The adhesive strips, self-adhering paper strips or the like form connection bridges between the stacks by which the adjacent stacks are stabilized against each other.

It is known from the German laying open letter 32 13 895 to provide connection bridges between stacks built of endless paper web folded in accordian fashion. The connection bridges are formed by a cutting knife including corresponding spaces. The application of such a method to corrugators would cause a considerable expense for the slitter scorer.

A later modification of an existing slitter scorer would increase this expense. Further, such supplement of a slitter scorer necessitates a stop of the complete cardboard production. Finally, the perforated longitudinal cutting of the webs do not allow to change the distance of the bridges in order to change the position of the bridges relative to the formate.

The apparatus according to the invention has the advantage that it can be mounted in existing corrugators without difficulties, without a great expense and without requiring a halt to production. The adhering strips require only a very small thickness and width in order to effect the desired stabilization. The applying means according to the invention have further the advantage that the position and the frequency of the application of the strips thereof can be adjusted voluntarily. By the invention the adhering strips could be positioned adjacent the front sides of the stacks by which they can be easily manually cut if the stacks are to be separated.

The adhesion of the strips to the webs can be very weak because they are only to secure that the cardboard sheets connected to each other are to be stacked commonly. Thereafter the pressure of the stack takes care for a relatively strong connection between the stacks.

The position of the cutting line in the slitter scorer will change if the formate changes. Therefore, the applying means are adapted to be moved transversely to the production direction. A preferred embodiment of the invention provides positioning means for the actuation of the applying means in conformity with the position of the cutting tools in the slitter scorer. The positioning can be carried out by an operator or automatically via synchronization with the positioning of the cutting tools.

The position of the edge of the cardboard web may change. It is therefore necessary either to correct the position of the edge or as is the usual way to move the slitter scorer in accordance with the position of the edge. A further embodiment of the invention provides control means for the position of the edge, the control means actuating the applying means through the positioning means in order to move the applying means transversely to the production direction in synchronization with the movement of the slitter scorer.

An embodiment of the invention will be described hereinafter along with the drawings.

Figure 1:
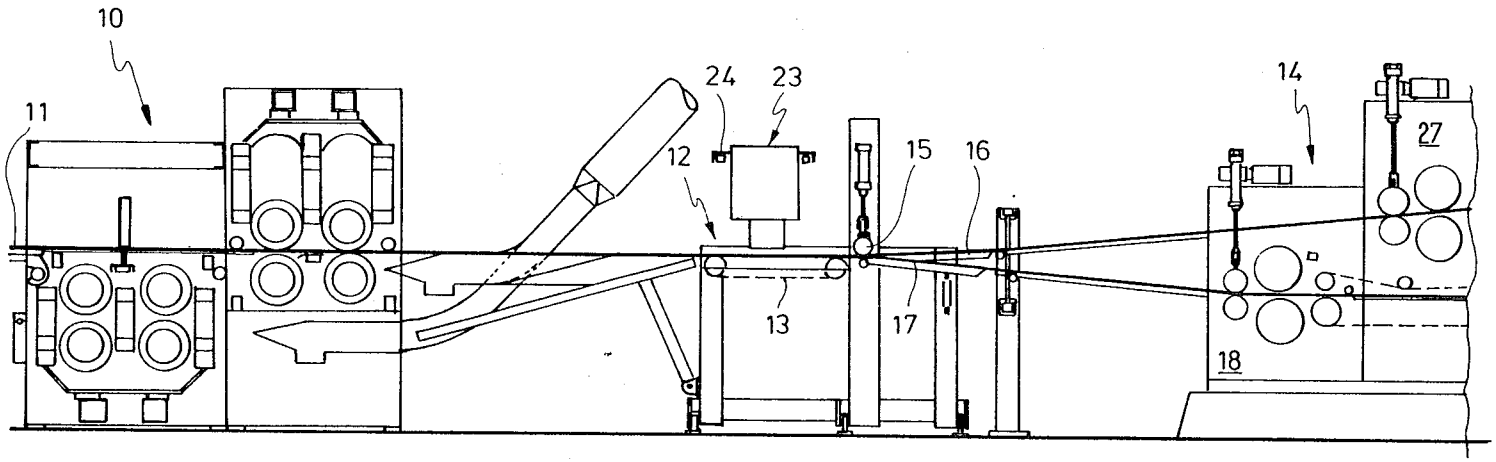
FIG. 1 shows schematically a side view of a portion of a corrugator including an apparatus according to the invention.
Figure 2:
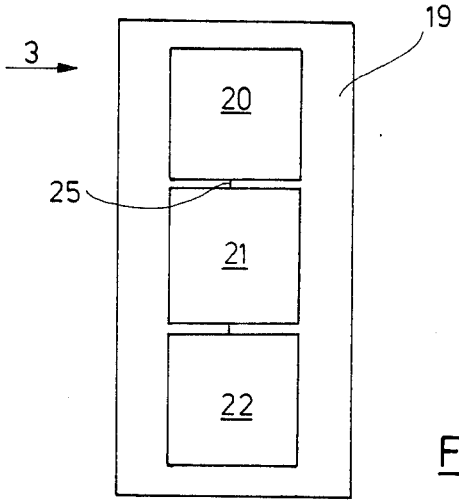
FIG. 2 shows schematically the top view on the platform of a stacker supporting three stacks adjacent each other.
Figure 3:
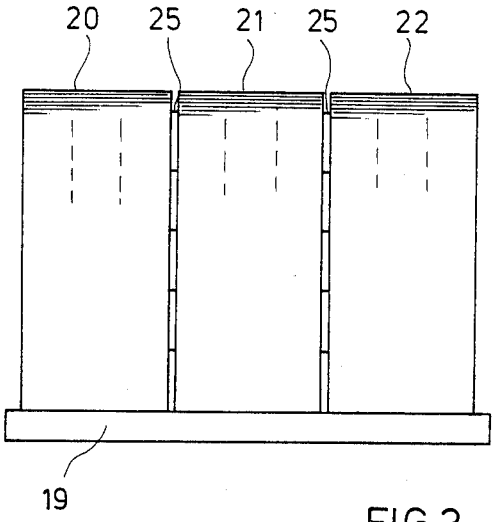
FIG. 3 shows the side view of the arrangement according to FIG. 2.

In FIG. 1 a slitter scorer 10 is illustrated schematically, a corrugated web 11 being fed to the slitter scorer 10. The corrugated web 11 is produced by a usual corrugator. The details of the slitter scorer 10 are not described since they are prior art. The slitter scorer 10 or the tools thereof, respectively are positioned to be moved transverse to the extension of the web 11 in relation to the position of the edge of the web 11. Control means are provided to carry out this function (not shown). The slitter scorer 10 cuts the web 11 longitudinally into individual smaller webs. In the present case it is assumed that the cardboard web 11 is subdivided into six smaller webs. The smaller webs are fed to conveying means 12 which include an endless vacuum belt 13 for the transport of the smaller webs to cut-off means 14. The conveying means 12 include a deflecting roller 15, two deflecting surfaces 16, 17 being located downstream of the roller 15. The deflecting surfaces 16, 17 are located adjacent each other. The deflecting surface 16 deflects for instance the left three webs to an upper unit 27 of the cut-off means 14 while the deflecting surface 17 directed downwardly deflects the three other right webs to a lower unit 18 of the cut-off means 14. The corrugated cardboard sheets cut off in the cut-off means 14 are fed in squamous form to a stacker (not shown) through lower and upper conveying means. The stacker includes two stacker platforms located behind each other, three stacks being formed on each of the platforms. In FIGS. 2 and 3 a stacker platform 19 is shown schematically. The FIGS. 2 and 3 show three stacks 20, 21, 22. In case of no specific measures the danger exists that the stacks 20 to 22 tilt or lose their balance. Therefore, applying means 23 are located above the vacuum belt 13. In case of six smaller webs five applying means are necessary because the slitter scorer 10 carries out five cuts. The applying means 23 can be moved transversely by means of rails 24. The adjustment of the applying means 23 which are movable independent from each other is achieved by suitable positioning means (not shown) which displace the applying means 23 in correspondence with a change of the position of the cutting tools in order to position the applying means above the gap of adjacent webs. The actuation of the applying means 23 can also be made by hand. The movement of the applying means 23 is furthermore synchronized with the movement of the slitter scorer 10 in order to follow the position of the edge of the web 10. By means of the applying means 23 individual easily releasable adhesive strips or the like are applied to adjacent webs bridging the gap therebetween. The distance between the bridges such made can be determined by suitable control means. The distances could be determined in dependence from a number of sheets or from a given length. In any case, bridges are formed between adjacent corrugated cardboard sheets which are indicated at 25 in the FIGS. 2 and 3. They improve the stability of the stacks 20 to 22. On the other hand the bridges can be easily cut or removed if the stacks 20 to 22 are transferred to further operational steps. If the bridges 25 are applied in response to the number of sheets the bridges could be applied adjacent the outer edges of the stacks 20 to 22 where they could be easily cut by hand if the stacks 20 to 22 are to be separated from each other.

We claim:

1. Apparatus for stacking of corrugated cardboard sheets on at least two stacks disposed adjacent each other in a stacker included in a corrugator, wherein a slitter scorer, first conveying means, cut-off means, second conveying means and a stacker are located each behind the other in conveying direction, characterized in that at least one applying means is located above the first conveying means, said applying means being supported for movement transverse to the conveying direction and said applying means being adapted to apply adhesive strips, self-adhering paper strips or the like to adjacent webs to form connection bridges between the stacks by which adjacent stacks are stabilized against each other.

2. The apparatus according to claim 1, characterized in that positioning means are provided for the actuation of the applying means in conformity with the position of the tools in the slitter scorer.

3. The apparatus according to claim 2, wherein control means are provided controlling the position of the edge of a web in order to adjust the slitter scorer automatically in conformity with the position of the web edge, characterized in that the control means control said positioning means for movement of said positioning means transversely to the conveying direction in synchronization with the movement of the slitter scorer.

* * * * *